US008536844B1

(12) United States Patent
Kumar et al.

(10) Patent No.: US 8,536,844 B1
(45) Date of Patent: Sep. 17, 2013

(54) SELF-CALIBRATING, STABLE LDO REGULATOR

(75) Inventors: Ajay Kumar, Dallas, TX (US); Krishnaswamy Nagaraj, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 83 days.

(21) Appl. No.: 13/420,914

(22) Filed: Mar. 15, 2012

(51) Int. Cl.
*G05F 1/59* (2006.01)
*G05F 1/613* (2006.01)

(52) U.S. Cl.
USPC ..... 323/273; 323/269

(58) Field of Classification Search
USPC ..... 323/268, 269, 273, 274, 275, 279, 323/280, 281
See application file for complete search history.

(56) References Cited

U.S. PATENT DOCUMENTS

| | | | | |
|---|---|---|---|---|
| 6,642,791 | B1 * | 11/2003 | Balan | 330/253 |
| 6,933,772 | B1 * | 8/2005 | Banerjee et al. | 327/541 |
| 6,952,091 | B2 * | 10/2005 | Bansal | 323/277 |
| 7,492,137 | B2 * | 2/2009 | Yamada | 323/280 |
| 7,646,188 | B2 * | 1/2010 | Suzuki | 323/284 |
| 7,723,968 | B2 * | 5/2010 | Okuyama et al. | 323/274 |
| 7,902,801 | B2 * | 3/2011 | Mandal | 323/273 |

* cited by examiner

*Primary Examiner* — Gary L Laxton
(74) *Attorney, Agent, or Firm* — John R. Pessetto; Wade J. Brady, III; Frederick J. Telecky, Jr.

(57) ABSTRACT

A substantially unconditionally stable LOD regulator includes has first and second current paths. The first current path provides a reference current. The second current path receives an input voltage for developing a differential current with respect to the reference current based on the input voltage. The second current path has a sense resistor for sensing the differential current. A first current source biases the first and second current paths. A third current path senses the differential current and develops the input voltage in response thereto to control the differential current. A second current source biases the second current path. A first voltage follower circuit receives a first voltage on a first side of the sense resistor to provide an analog voltage output, and a second voltage follower circuit receives a second voltage on a second side of the sense resistor to provide a digital voltage output.

20 Claims, 2 Drawing Sheets

SELF-CALIBRATING, STABLE LDO REGULATOR

BACKGROUND

1. Field

The various method and circuit embodiments described herein relate in general to low-drop out (LDO) regulators, and, more specifically, to self-calibrating, stable LDO regulators of the type described that are substantially unconditionally stable and which can be constructed with small or no capacitor structures.

2. Background

LDO regulators are linear DC voltage regulators, and are used widely in mixed-signal system on chip (SoC) devices. Present-day SoCs, for example, may contain digital, analog, mixed-signal, and often radio-frequency functions, all on a single chip or substrate, which may, for instance, form a part of an embedded system. Examples of some of the various circuits that may be found on an SoC may include amplifiers, analog-to-digital converters (ADCs), digital-to-analog converters (DACs), phase-locked loops (PLLs), and the like.

Many of the mixed signal SoC functions produce spurious emissions in the Megahertz range of frequencies, where traditional LDO regulators do not maintain low-impedance output. This negatively impacts the isolation between the various circuits on the SoC. Nevertheless, LDO regulators often are used for supply isolation between various SoC circuits.

An electrical schematic diagram of a typical LDO regulator 10 is shown in FIG. 1, to which reference is now made. The LDO regulator 10 has a first amplifier 12 having a reference voltage (VBG) on its non-inverting input, provided, for example, by a band-gap reference voltage supply (not shown). VBG may be, for instance, about 1.0 V or 1.2 V. The inverting input of the first amplifier 12 has a fraction of the output voltage applied thereto that is developed by a resistor divider that includes resistors 14 and 16. The voltage applied to the inverting input of the first amplifier 12 may be about equal to VBG, so that the voltage output of the first amplifier 12 represents the voltage difference between VBG and the divided voltage developed at the tap on resistor 16. The first amplifier 12 may have a relatively low bandwidth, for example, of about 10 KHz to limit the noise from the bandgap voltage regulator that may otherwise pass to the output.

A second amplifier 18 receives the output from the first amplifier 12. The second amplifier 18 has a wide bandwidth, for example, of about 1 MHz, to maintain a low-impedance output across its operating frequencies, up to a known corner frequency. The output of the second amplifier 18 is connected to the gate of an FET 20. The source of the FET 20 is connected to VCC and the drain is connected to one end of the resistor 16. The other end of the resistor 16 is connected to a reference potential, or ground. The output of the LDO regulator is taken from the drain of the FET 20 on node 22, and is typically about 1.4 V.

LDO regulators of the type shown in FIG. 1 typically have two loops, one having a high impedance node 19 at the gate of the FET 20, driving a single low impedance output, $V_{out}$, on node 22. The output impedance, therefore, is established by the total resistance of the resistors 14 and 16 divided by the loop gain. Such LDO regulators are best suited for off-chip capacitor structures or in applications where the bandgap voltage, VBG, is far away from the LDO regulator output voltage, $V_{OUT}$. Traditional LDO regulators are designed for given load currents and capacitances, and have to be stable for a given $I_{LOAD}/C_{LOAD}$. However, the stability of traditional LDO regulators degrades dramatically under low load current and high load capacitance scenarios. Moreover, traditional LDO regulators have poor suppression of spurious emissions at high frequencies.

As shown in the graph of FIG. 2, traditional LDO regulators of the type shown in FIG. 1 maintain a low R in the OUT 20 ohm range below about 1 MHz, illustrated by the curve 24. This gradually increases into the Kohm range at higher frequencies, shown by the curve 26. At frequencies above 10 MHz, $R_{out}$ may be greater than 200 ohms, and may increase to the Mohm range at even higher frequencies. At the same time, the bandwidth of the second amplifier 18 circuit is substantially flat up to 1 MHz, shown by curve 28, then decreases above 1 MHz, shown by curve 30.

The efficiency of the circuit 10, $R_{out_}$eff, is approximately $R_{out}$/(loop gain). $R_{out}$ is established by the size of the resistors 14 and 16, which may be on the order of about 100 Kohms. However, as the loop gain starts to fall above a 3 dB frequency, $R_{out}$ starts to go up (see, for example, the curves of FIG. 2 where the 3 dB frequency is about 1 MHz). Consequently, in the past, LDO regulators had to be redesigned every time with each new application, depending on the frequencies of operation and the capacitive loads on the output.

In addition to the challenges described above, present LDO regulators require a large portion of the circuit area in integrated circuit constructions. For example, in a PLL, an LDO regulator may take as much as ¼ of the PLL area.

The current consumption and necessary decoupling capacitors vary greatly from application to application. Analog circuits are mostly designed with VDDA (~=1.4V) using high voltage gate devices. Digital circuits require VDD regulation to 1.2V, as they are built using core devices. Currents of most analog blocks are small, for example, about 2 to 5 mA. However, most analog blocks are sensitive to SoC noise. For example, in mixed signal applications, ADC, DAC, and PLL circuits generate noise at their clock frequencies, which may be between about 1 to 50 MHz. As discussed above, traditional LDO regulators have a very large $R_{OUT}$ at the higher range of these frequencies. Consequently, LDO regulators are often designed to be independent of the analog block currents and noise.

What is needed, therefore, is an unconditionally stable LDO regulator to drive loads over a large range of load capacitors and currents. There is also a need for a small LDO regulator that has a low output resistance, $R_{OUT}$, at MHz frequencies, and that can supply current to both analog and digital circuits.

SUMMARY

The method and circuit embodiments described herein provide an unconditionally stable LDO regulator architecture with a low impedance output stage. In the LDO regulator architecture, stability is controlled by an internal node, which is independent of the load and of $I_{LOAD}/C_{LOAD}$. The low impedance output stage can provide both analog and digital regulated supply voltages for mixed signal applications. Since load current are small, the LDO regulator can be implemented in a small area, compared to previous LDO regulator circuits.

In one embodiment, a digital integrator loop is provided to enable fine regulation of the digital supply, and multiple output stages driven from same high impedance node may be provided to enable different output voltages with good isolation.

Thus, according to one embodiment an LOD regulator described herein a differential amplifier is provided. The differential amplifier has a first current path for receiving a reference voltage for controlling a reference first current in the first current path, and a second current path for receiving an input voltage for developing a differential second current in the second current path with respect to the first current based on the input voltage. A first current source biases the first and second current paths. A third current path senses the second current and developing the input voltage in response to the sensed second current to control the second current. A second current source biases the second current path a first voltage follower circuit receives a voltage from the second current path to provide an analog voltage output.

In one embodiment, a second voltage follower circuit receives a voltage from the second current path to provide a digital voltage output. A digital error circuit adjusts an effective size of a pass transistor in the second voltage follower circuit in dependence on variations in the digital voltage output. The digital error circuit includes a plurality of switches and a corresponding plurality of transistors, wherein selected ones of the plurality of transistors may be connected in parallel with the pass transistor by the switches, and also includes a differential amplifier having one input for receiving a reference voltage from the third current path and another input for receiving the digital voltage output, and a digital integrator having an input receiving an output of the differential amplifier and outputs for controlling the plurality of switches.

According to another embodiment an LOD regulator is described herein in which a differential amplifier is provided. The differential amplifier includes first and second current paths. The first current path receives a reference voltage for controlling a reference first current. The second current path receives an input voltage for developing a differential second current in the second current path with respect to the first current based on the input voltage. The second current path has a sense resistor therein for developing a voltage sensing the second current. A first current source biases the first and second current paths. A third current path senses the second current and develops the input voltage in response to the sensed second current to control the second current. A second current source biases the second current path. A first voltage follower circuit receives a first voltage on a first side of the sense resistor to provide an analog voltage output, and a second voltage follower circuit receives a second voltage on a second side of the sense resistor to provide a digital voltage output.

In one embodiment a digital error circuit adjusts an effective size of a pass transistor in the second voltage follower circuit in dependence on variations in the digital voltage output. The digital error circuit includes a plurality of switches and a corresponding plurality of transistors, wherein selected ones of the plurality of transistors may be connected in parallel with the pass transistor by the switches. The digital error circuit also includes a differential amplifier having one input for receiving a reference voltage from the third current path and another input for receiving the digital voltage output and a digital integrator having an input receiving an output of the differential amplifier and outputs for controlling the plurality of switches.

In yet another embodiment, an LOD regulator is described herein in which a first current path provides a reference current. A second current path receives an input voltage for developing in response to the input voltage a differential current with respect to the reference current. A first current source for biases the first and second current paths. A third current path senses the differential current and developing the input voltage in response thereto. A second current source biases the second current path. A first voltage follower circuit receives a first output voltage from the second current path to provide an analog voltage output, and a second voltage follower circuit for receiving a second output voltage from the second current path to provide a digital voltage output.

In one embodiment, a digital error circuit adjusts an effective size of the pass transistor of the second voltage follower circuits in dependence on variations in the digital voltage output. The digital error circuit includes a plurality of switches and a plurality of transistors, each transistor associated with a respective one of the plurality of switches. Each of the switches selectively connects a transistor in parallel with a pass transistor in the second voltage follower circuit. A differential amplifier having one input for receiving a reference voltage from the third current path and another input for receiving the digital voltage output, and a digital integrator having an input receiving an output of the differential amplifier and outputs for controlling the plurality of switches.

BRIEF DESCRIPTION OF THE DRAWINGS

In the various figures of the drawing, like reference numbers are used to denote like or similar parts.

DETAILED DESCRIPTION

The LDO regulator architecture described herein closes the LDO regulation loop internally with known poles and zeros to ensure stability of analog and digital output voltages, VDDA and VDD, respectively. A replica source-follower circuit is used to generate low-impedance outputs for a digital output voltage, VDD. The guaranteed stability comes at the price of variations in the digital output voltage equal to the $V_{GST}$ of the pass-transistor. This is addressed by having a slow digital error correction circuit built around the output voltage that controls the size of the pass transistor to regulate the output voltage, within bounds. This enables an LDO regulator to be constructed in less than the area and with ½ the power consumption of custom built traditional LDO regulators. The ability to achieve small area constructions allows the liberal use of a number of LDO regulators to provide supply isolation between other circuits and systems on the SoC.

The pass transistors are not part of the LDO regulator stability loop. Therefore, the same LDO regulator can be used to generate both analog and digital supply voltages for a mixed signal applications. In use, the savings becomes double with the added advantage that application-to-application isolation is provided at the SoC level.

Figure 1:
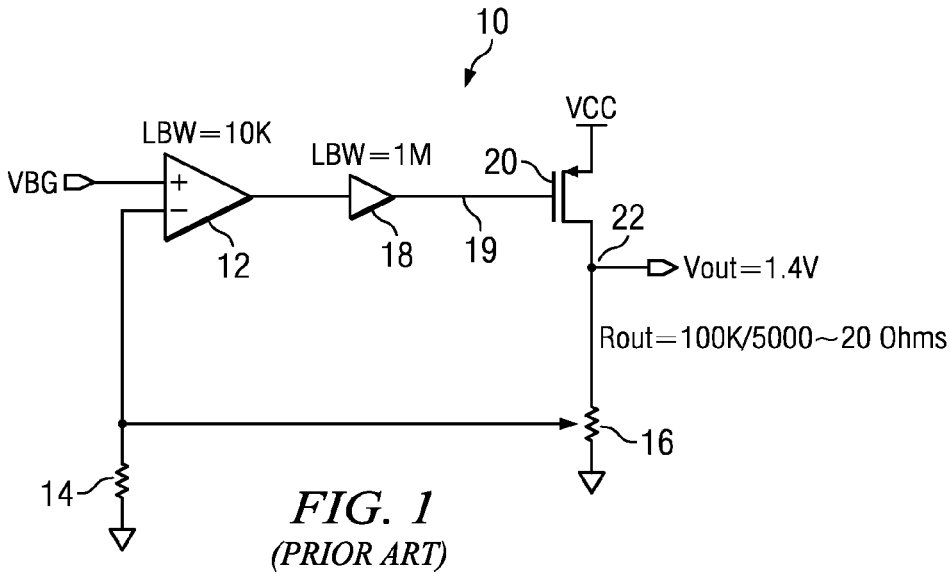
FIG. 1 (PRIOR ART)
FIG. 1 is an electrical schematic diagram of a typical prior art LDO regulator.
Figure 2:
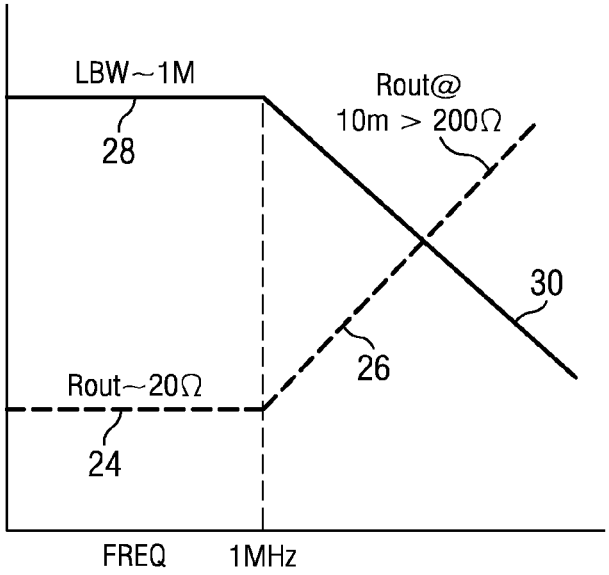
FIG. 2 (PRIOR ART)
FIG. 2 illustrates graphs of resistance vs. frequency and loop bandwidth vs. frequency of the LDO regulator of FIG. 1.
Figure 3:
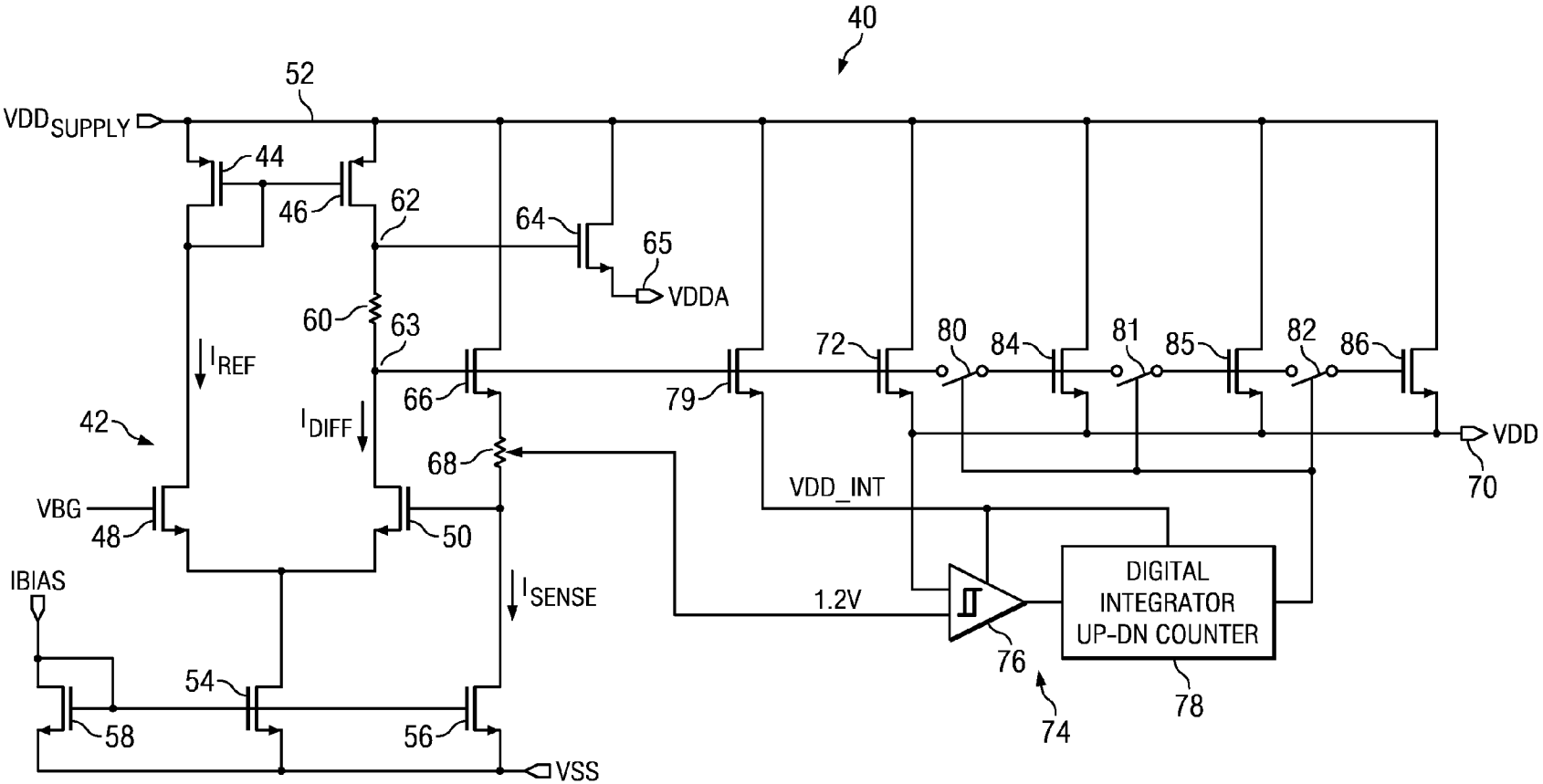
FIG. 3 is an electrical schematic diagram of an unconditionally stable LDO regulator having both analog and digital outputs.

An electrical schematic diagram of an unconditionally stable LDO regulator 40 having both analog and digital outputs is shown FIG. 3 to which reference is now made. The LDO regulator 40 has a differential amplifier 42 having pmos load transistors 44 and 46 and nmos input transistors 48 and 50. The pmos load transistor 44 and nmos input transistor 48 establish a first current path, and the pmos load transistor 46 and nmos input transistor 50 establish a second current path.

The sources of the pmos load transistors 44 and 46 are connected to a supply voltage $V_{SUPPLY}$ on line 52. Current sources are provided by nmos transistors 54 and 56, which mirror the current established by the nmos transistor 58. A bias current is connected to the drain and gate of the nmos transistor 58, and the sources of each nmos transistor 58, 54, and 56 are connected to a reference potential, VSS. Thus, a reference first current, $I_{REF}$, is developed in the first current path and a differential second current, $I_{DIFF}$, is developed it the second current path.

A current sensing resistor 60 is connected between the drain of the pmos transistor 46 and the drain of nmos transistor 50. It is noted that the node 62 is a high-impedance node, which supplies the control voltage to the analog output nmos transistor 64. The nmos transistor 64 is connected to provide a voltage follower circuit, and in the example circuit 40 of FIG. 3, a source follower circuit.

The analog voltage output, VDDA, which may be, for example, 1.4 V is developed on the source of the nmos transistor 64 on output node 65. The source follower output stage provided by the nmos transistor 64 has a low output impedance over a wide frequency range. In one embodiment, $R_{ouT}$ can be established to be low, for example, less than 100 ohms, for instance less than 50 ohms at Megahertz frequencies. This also assists in reducing any coupling between other circuit modules on the SoC.

The voltage output developed in the loop of the differential amplifier 42 is controlled by a third current path, including an nmos transistor 66 in series with a variable resistor 68 and the current source nmos transistor 56. The nmos transistor 56 may be small, for example, 24 square microns, in contrast, for example to the size of the 60 Kohm resistor used in previous circuits, which takes about 320 square microns. A third current, $I_{SENSE}$, is generated in the third current path by the voltage on the gate of the nmos transistor 66, which is developed on the drain of the nmos transistor 50 in the second current path.

With the circuit constructed as above described, the source follower output stage provided by the nmos pass transistor is outside of the internal loop of the differential amplifier 42. Therefore, since the stability of the circuit is controlled by the internal loop of the differential amplifier 42, the stability of the circuit is independent of $_{CLOAD}$ and $_{ILOAD}$.

Moreover, if the resistor 60 is made to have a resistance of 40 Kohm, with a capacitance of about 5 pf, a pole is produced at 0.8 MHz. This effectively isolates the analog output voltage, VDDA, from the digital output voltage VDD (below described).

In one example of the operation of the analog portion of the circuit 40 described above, $VDD_{SUPPLY}$ may be about 3 V and VBG may be about 0.9 V. ($VDD_{SUPPLY}$ should be sufficient to provide headroom of at least $VDDA+V_{TH}+V_{ON}$.) The nmos transistor 66, resistor 68, and nmos transistor 56 are constructed so that the voltage on the gate of the nmos transistor 50 is substantially the same as VBG, in this example, about 0.9 V. The voltage dropped across resistor 60 is about 200 mV, which controls the analog output voltage on output node 62 to be about 1.4 V ($+V_{th}+V_{GST}$). This makes the voltage on output node 63 to be about 1.2 V ($+V_{th}+V_{GST}$). When the load is light (small current), VGST of the output device 0 mV. Under low current condition, VDDA can go up by VGST (~150 mV), however, this is not a problem, since VDDA can withstand 1.8V.

Although the circuit embodiment shown in FIG. 3 uses no capacitors, if desired, a small compensation capacitor, for example, of about 1 pf, (not shown) optionally may be connected between the gate of the nmos transistor 64 and ground to improve the power supply rejection ratio (PSRR). Similarly, a small capacitor of about 1 pf (not shown) optionally may be connected between the gate of nmos transistor 66 and ground. Capacitors of this size can be achieved without substantially increasing the size of the overall circuitry.

The digital output of the circuit 40 is developed on a digital output node 70 by second voltage follower circuit, which is a source follower circuit in the embodiment shown in FIG. 3. The source follower circuit includes an nmos pass transistor 72. The gate of the nmos pass transistor 72 is connected to the drain of the nmos transistor 50, whereby the resistor 60 isolates the analog output voltage, VDDA, from the digital output voltage, VDD, as described above. The digital output voltage may be, for example, 1.2 V.

The stability of the circuit 40, however, comes at the price of variations in the digital output voltage, VDD, equal to the $_{VGST}$ of the nmos pass transistor 72. This may be addressed by having a slow digital error correction circuit 74 built around the output voltage to controls the effective size of the pass transistor 72 to regulate the voltage, VDD, on the digital output node 70, within bounds. The digital error correction circuit 74 has a comparator 76 to compare the voltage on the digital output node with a reference voltage, which may be the desired digital output voltage, such as 1.2 V shown in the example illustrated. The reference voltage may be developed at a tap on the resistor 68.

The comparator 76 has a predetermined amount of hysteresis, for example, 28 mV, so that the digital error correction circuit 74 does not rapidly switch or dither when the digital output voltage, VDD, has only slight variations near a trigger point, as described below. The output from the comparator 76 controls a digital integrator, which may be an up-down counter 78. An nmos transistor 79 provides a supply voltage, VDD_INT, to the comparator 76 and the up-down counter 78, as shown.

The output from the up-down counter 78 controls switches 80-82 which selectively connect the gates of replicating nmos pass transistors 84-86 to the gate of the nmos pass transistor 72. This effectively connects selected replicating nmos pass transistors 84-86 in parallel with the nmos pass transistor 72 at respective voltage trigger points. This effectively controls the size of the pass transistor 72 to regulate the voltage, VDD, on the digital output node 70. Thus, if the comparator 76 detects a higher voltage on the digital output node 70, the up-down counter 78 will count down to a trigger point at which the number of "fingers" placed in parallel with the nmos transistor 72 is reduced. On the other hand, smaller output devices for the same current with a large VGST will push the digital output voltage, VDD, down to lower value. Under low current conditions, for example, VDD can go up by VGST (about 150 mV).

The LDO regulator of the type shown in the example of FIG. 3 has numerous technical advantages. For example, since all of the nodes that affect the stability of the circuit are internal, the circuit is substantially unconditionally stable over a wide range of output capacitances at small current values, and may be suitable for in applications in which the output currents are in the range of 0 to 20 mA. The output can be set at a desired low impedance, compared with the high impedance output of previous LDO regulators. LDO regulators of the type described herein can be used to supply both analog and digital regulated voltages. In addition, an additional digital voltage output circuit can be employed with the LDO regulators of the type described herein to improve the accuracy of the digital output voltage. Since there may be no capacitors in the circuit (depending on the application), and the large resistors of prior LDO regulators have been replaced with smaller current sources, the overall size of the LDO regulators of the type described herein can be reduced, for instance, to as much as ⅕ the size of the prior LDO regulators.

Electrical connections, couplings, and connections have been described with respect to various devices or elements.

The connections and couplings may be direct or indirect. A connection between a first and second electrical device may be a direct electrical connection or may be an indirect electrical connection. An indirect electrical connection may include interposed elements that may process the signals from the first electrical device to the second electrical device.

Although the invention has been described and illustrated with a certain degree of particularity, it should be understood that the present disclosure has been made by way of example only, and that numerous changes in the combination and arrangement of parts may be resorted to without departing from the spirit and scope of the invention, as hereinafter claimed.

The invention claimed is:

1. An LOD regulator, comprising:

a differential amplifier having a first current path for receiving a reference voltage for controlling a reference first current in said first current path, and a second current path for receiving an input voltage for developing a differential second current in said second current path with respect to said first current based on said input voltage;

a first current source for biasing said first and second current paths;

a third current path for sensing said second current and developing said input voltage in response to the sensed second current to control said second current;

a second current source to bias said second current path; and a first voltage follower circuit for receiving a voltage from the second current path to provide an analog voltage output.

2. The LDO regulator of claim 1 wherein said voltage follower circuit is a source follower circuit.

3. The LOD regulator of claim 1 further comprising a second voltage follower circuit for receiving a voltage from the second current path to provide a digital voltage output.

4. The LOD regulator of claim 3 wherein said second voltage follower circuit is a source follower circuit comprising a pass transistor.

5. The LDO regulator of claim 4 further comprising a digital error circuit to adjust an effective size of said pass transistor in dependence on variations in said digital voltage output.

6. The LDO regulator of claim 5 wherein said digital error circuit comprises a plurality of switches and a corresponding plurality of transistors, wherein selected ones of said plurality of transistors may be connected in parallel with said pass transistor by said switches.

7. The LDO regulator of claim 6 further comprising a differential amplifier having one input for receiving a reference voltage from said third current path and another input for receiving the digital voltage output; and a digital integrator having an input receiving an output of said differential amplifier and outputs for controlling said plurality of switches.

8. The LDO regulator of claim 7 wherein said differential amplifier has a predetermined amount of hysteresis.

9. An LOD regulator, comprising:

a differential amplifier including first and second current paths, said first current path for receiving a reference voltage for controlling a reference first current, said second current path for receiving an input voltage for developing a differential second current in said second current path with respect to said first current based on said input voltage, said second current path having a sense resistor therein for developing a voltage sensing said second current;

a first current source for biasing said first and second current paths;

a third current path for sensing said second current and developing said input voltage in response to the sensed second current to control said second current;

a second current source to bias said second current path;

a first voltage follower circuit for receiving a first voltage on a first side of said sense resistor to provide an analog voltage output; and a second voltage follower circuit for receiving a second voltage on a second side of said sense resistor to provide a digital voltage output.

10. The LDO regulator of claim 9 wherein said first and second voltage follower circuits are source follower circuits.

11. The LOD regulator of claim 10 wherein said first and second voltage follower circuits each comprise a pass transistor.

12. The LDO regulator of claim 11 further comprising a digital error circuit to adjust an effective size of said pass transistor of said second voltage follower circuit in dependence on variations in said digital voltage output.

13. The LDO regulator of claim 12 wherein said digital error circuit comprises a plurality of switches and a corresponding plurality of transistors, wherein selected ones of said plurality of transistors may be connected in parallel with said pass transistor by said switches.

14. The LDO regulator of claim 13 further comprising a differential amplifier having one input for receiving a reference voltage from said third current path and another input for receiving the digital voltage output; and a digital integrator having an input receiving an output of said differential amplifier and outputs for controlling said plurality of switches.

15. The LDO regulator of claim 14 wherein said differential amplifier has a predetermined amount of hysteresis.

16. An LOD regulator, comprising:

a first current path for providing a reference current;

a second current path for receiving an input voltage for developing in response to said input voltage a differential current with respect to said reference current;

a first current source for biasing said first and second current paths;

a third current path for sensing said differential current and developing said input voltage in response thereto;

a second current source to bias said second current path;

a first voltage follower circuit for receiving a first output voltage from the second current path to provide an analog voltage output; and a second voltage follower circuit for receiving a second output voltage from the second current path to provide a digital voltage output.

17. The LDO regulator of claim 16 wherein said first and second voltage follower circuits are source follower circuits.

18. The LOD regulator of claim 16 wherein said first and second voltage follower circuits are source follower circuits, each comprising a pass transistor.

19. The LDO regulator of claim 18 further comprising a digital error circuit to adjust an effective size of said pass transistor of said second voltage follower circuits in dependence on variations in said digital voltage output.

20. The LDO regulator of claim 19 wherein said digital error circuit comprises:

a plurality of switches;

a plurality of transistors, each associated with a respective one of said plurality of switches, each of said switches selectively connects a transistor in parallel with said pass transistor;

a differential amplifier having one input for receiving a reference voltage from said third current path and another input for receiving the digital voltage output; and a digital integrator having an input receiving an output of said differential amplifier and outputs for controlling said plurality of switches.

* * * * *